US007147901B2

(12) United States Patent
Kasamatsu et al.

(10) Patent No.: US 7,147,901 B2
(45) Date of Patent: Dec. 12, 2006

(54) BOTH-SIDED INK JET RECORDING SHEET

(75) Inventors: Kunio Kasamatsu, Tokyo (JP); Katsuhiko Kawasaki, Tokyo (JP); Suguru Kashima, Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 0 days.

(21) Appl. No.: 10/466,556

(22) PCT Filed: Oct. 29, 2002

(86) PCT No.: PCT/JP02/11210

§ 371 (c)(1),
(2), (4) Date: Jul. 25, 2003

(87) PCT Pub. No.: WO03/045702

PCT Pub. Date: Jun. 5, 2003

(65) Prior Publication Data

US 2004/0058145 A1 Mar. 25, 2004

(30) Foreign Application Priority Data

Nov. 28, 2001 (JP) ..... 2001-361804
Sep. 25, 2002 (JP) ..... 2002-279900

(51) Int. Cl.
*B41M 5/00* (2006.01)

(52) U.S. Cl. ..... 428/32.25; 428/32.22; 428/32.33; 428/32.34

(58) Field of Classification Search ..... 428/32.22, 428/32.25, 32.33, 32.2
See application file for complete search history.

(56) References Cited

U.S. PATENT DOCUMENTS 5,576,088 A 11/1996 Ogawa et al.
5,609,964 A * 3/1997 Ogawa et al. ..... 428/520
6,335,085 B1 * 1/2002 Asano et al. ..... 428/32.25
6,638,585 B1 * 10/2003 Niu et al. ..... 428/32.22

FOREIGN PATENT DOCUMENTS

| | | |
|---|---|---|
| DE | 199 56 999 | 5/2000 |
| EP | 0 791 474 A2 | 8/1997 |
| JP | 7-25133 | 1/1995 |
| JP | 7-179025 | 7/1995 |
| JP | 2000-85242 | 3/2000 |
| JP | 2001-39011 | 2/2001 |
| JP | 2001-96904 | 4/2001 |
| JP | 2001-105722 | 4/2001 |
| JP | 2001-191641 | 7/2001 |
| JP | 2001-277699 | 10/2001 |

OTHER PUBLICATIONS

A copy of the German Patent Office Action for corresponding German patent No. 102 95 889.9-45, dated May 16, 2006, and the English translation (5 sheets.).

* cited by examiner

*Primary Examiner*—Pamela R. Schwartz
(74) *Attorney, Agent, or Firm*—Armstrong, Kratz, Quintos, Hanson & Brooks, LLP

(57) ABSTRACT

The object of the present invention is to obtain a double-side ink jet recording sheet at least one side of which has gloss surface and in which scratches caused by rubbing of sheets hardly occur. According to the present invention, there is obtained a double-side ink jet recording sheet comprising a support provided with at least one ink-receiving layer on each of both sides, wherein at least one side has a gloss surface having a 75° specular glossiness of not less than 40% and the ink-receiving layer on the side opposite to the side having gloss surface contains organic particles having an average particle diameter of 2–40 μm. The outermost layer of the side having the gloss surface is preferably formed by subjecting to pressure-contact specular finishing by cast-coating method.

12 Claims, No Drawings

BOTH-SIDED INK JET RECORDING SHEET

TECHNICAL FIELD

The present invention relates to an ink jet recording sheet used in printers utilizing ink jet recording systems. Particularly, it relates to a double-side ink jet recording sheet, at least one side of which has gloss.

BACKGROUND ART

Ink jet recording systems perform recording of images or letters by ejecting ink droplets according to various operational principles and depositing them on recording sheets such as paper. The recording systems have the features that they carry out the operation at high speed, produce little noise, can easily perform multicolor printing, are great in versatility of patterns to be recorded, and require no development-fixation, and the systems recently rapidly spread as recording apparatuses in various uses for recording various figures and color images including Chinese characters. Furthermore, the images obtained by multicolor ink jetting systems are not inferior in quality to the recorded images obtained by the multicolor printing according to plate making systems or the color photographic systems. Moreover, when a small number of prints are to be produced, they can produce the prints more cheaply than the photographic techniques. Thus, ink jet recording systems are being widely applied to the field of full-color image recording.

Recently, cheap ink jet printers which can output highly minute images comparable to images of silver salt photography are commercially available. Ink jet recording sheets can produce images equal in quality to those obtained by silver salt photographic systems and, besides, are very cheap, and, therefore, they provide economically great merit for users who change frequently the images in commercial samples or in advertisement requiring images of large area. Furthermore, according to the silver salt photographic systems, it is utterly impossible to prepare images on personal computers and amend color arrangement or layout with seeing the print out which is recently generally carried out, while such operations can be readily performed by the ink jet recording systems. Under the circumstances, ink jet recording sheets having gloss are increasingly demanded. Moreover, ink jet recording sheets having suitability for carrying out ink jet recording also on back side are marketed, and these are used for photograph-like picture postcards or cards.

As the ink jet recording sheets having high gloss, there are proposed those obtained by using cast-coating method (see, e.g., JP-A-11-48604 and JP-A-2000-85242). Furthermore, a coat is provided on another side of these sheets for imparting suitability for printing by ink jet recording.

However, in the conventional double-side ink jet recording sheets having gloss on one side, scratches sometimes occur on the gloss side owing to rubbing of the gloss side with the opposite side. When they are used for picture postcards or cards, in many cases, a plurality of the sheets are set in a printer and continuous printing is carried out, and scratches are apt to occur. As a result, not only the unprinted portions, but also printed portions are considerably damaged in quality, which is a serious problem.

Furthermore, it is proposed to add organic particles to ink-receiving layer, overcoat layer, back coat layer, etc. (see, e.g., JP-A-2-223466, JP-A-7-25133, JP-A-7-179025, JP-A-11-277881, and JP-A-2001-105722), but these inventions aim at improvement of ink absorbability, improvement of carrying property in printers, inhibition of blocking between the sheets, improvement of water resistance of the ink-receiving layer, and improvement of surface strength of the ink-receiving layer (inhibition of exfoliation), and it has been impossible to inhibit damages on the gloss surface of double-side ink jet recording sheets having one gloss surface side which are caused by rubbing of the sheets with each other.

Moreover, it is proposed to add thermoplastic organic particles to the outermost layer on the gloss surface side, thereby improving scuff resistance (see, e.g., JP-A-2000-158803 and JP-A-2000-203151). However, according to these technologies, ink absorbability tends to deteriorate because the thermoplastic resin is heated in the ink-receiving layer to densify it, and thus it is difficult to satisfy both the ink absorbability and the inhibition of occurrence of scratches on the gloss surface side.

The object of the present invention is to provide a double-side ink jet recording sheet which comprises a paper as a support and has gloss on at least one side and in which there hardly occur damages of the gloss surface side owing to rubbing of the sheets with each other.

DISCLOSURE OF INVENTION

The present invention relates to a double-side ink jet recording sheet comprising a paper support having at least one ink-receiving layer on each of both sides, wherein the ink-receiving layer on at least one side has gloss surface having a 75° specular glossiness of not less than 40% measured in accordance with JIS Z8741 and the outermost ink-receiving layer on the side of the paper support opposite to the side having gloss surface contains organic particles having an average particle diameter of 2–40 μm.

It is preferred that the outermost layer on the gloss surface side is subjected to pressure-contact specular finishing by cast-coating method. In this case, when the 75° specular glossiness of the gloss surface measured in accordance with JIS Z8741 is not less than 70%, the effect of the present invention is highly exhibited, which is more preferred.

It is preferred that the average particle diameter of the organic particles is in the range of 2–20 μm, and furthermore the organic particles are of a polyolefin resin.

The present invention further relates to a double-side ink jet recording sheet comprising a paper support having at least one ink-receiving layer on each of both sides, wherein the ink-receiving layer on at least one side has gloss surface having a 75° specular glossiness of not less than 40% measured in accordance with JIS Z8741, the outermost ink-receiving layer on the side of the paper support opposite to the side having gloss surface contains organic particles having an average particle diameter of 2–40 μm, and the outermost layer on the gloss surface side is subjected to a smoothing treatment by a super calender.

It is preferred that the average particle diameter of the organic particles is in the range of 2–20 μm, and furthermore the organic particles are of a polyolefin resin.

The present invention further relates to a double-side ink jet recording sheet comprising a paper support having at least one ink-receiving layer on each of both sides, wherein the ink-receiving layer on at least one side has gloss surface having a 75° specular glossiness of not less than 40% measured in accordance with JIS Z8741, the outermost layer of the ink-receiving layer on the side of the paper support opposite to the side having gloss surface contains organic particles having an average particle diameter of 2–40 μm, and wherein the gloss surface side comprises at least an ink absorbing layer mainly composed of a pigment and a binder and a gloss developing layer mainly composed of inorganic ultrafine particles having an average particle diameter of less than 1 μm and a binder provided on the ink absorbing layer as an outermost layer and the pigment contained in the ink absorbing layer is a salt of an alkaline earth metal.

It is preferred that the gloss developing layer is provided by coating a coating solution on the ink absorbing layer, and the coating solution for the gloss developing layer has a pH of not higher than 5.0.

The salt of an alkaline earth metal is preferably calcium carbonate.

It is preferred that the inorganic ultrafine particles having an average particle diameter of less than 1 μm contained in the gloss developing layer is an amorphous synthetic silica prepared by a gas phase method or an alumina compound.

It is preferred that the average particle diameter of the organic particles is in the range of 2–20 μm, and furthermore the organic particles are of a polyolefin resin.

BEST MODE FOR CARRYING OUT THE INVENTION

The double-side ink jet recording sheet of the present invention will be explained in detail below.

The present invention relates to a double-side ink jet recording sheet having gloss on at least one side where the damage of the gloss surface caused by rubbing of the sheets with each other is inhibited by improving the side opposite to the gloss surface side. Specifically, the present invention is characterized in that the ink-receiving layer provided on the side opposite to the gloss surface side contains organic particles having an average particle diameter of 2–40 μm.

When the ink-receiving layers on both sides of the ink jet recording sheet of the present invention have gloss surface, the outermost layer of only one side can contain the organic particles, but both the sides may contain the organic particles.

The mechanism of the effect being developed is considered as follows. That is, since organic particles which are lower in mechanical hardness than inorganic pigment are exposed on the surface, the mechanical damage of the gloss surface caused by rubbing of the sheets with each other can be inhibited. For the organic particles being effectively exposed on the surface, the average particle diameter is needed to be 2–40 μm, and it is necessary that the particles are not completely deformed after coated on the sheet and do not act as a binder, but maintain the shape of the particles to some extent. When the average particle diameter is 2–20 μm, color formability which is an ink jet recording characteristic is further improved, which is preferred.

Materials of the organic particles are not particularly limited, and as examples thereof, mention may be made of particles of general organic materials such as polyamide resins, polyester resins, polycarbonate resins, polyolefin resins, polysulfone resins, polystyrene resins, polyvinyl chloride resins, polyvinylidene chloride resins, polyphenylene sulfide resins, ionomer resins, acrylic resins, vinyl resins, urea resins, melamine resins, urethane resins, nylons, copolymer compounds of these resins, cellulosic compounds, starches, etc. Among them, preferred are polyolefin resins, polystyrene resins, acrylic resins and starches, and polyolefin resins are especially preferred. The shape of the organic particles are not particularly limited, but it is considered that the shape closer to sphere is preferred, and the shape of true sphere is most preferred.

The amount of the organic particles in the outermost layer of the ink-receiving layer on the side of the support opposite to the gloss surface side is preferably 1–50% in weight ratio based on the whole outermost layer of the ink-receiving layer. If the amount of the organic particles is less than 1%, there may be exhibited substantially no effect of inhibiting the occurrence of scratches on the gloss surface, and if it is more than 50%, properties such as ink absorption and color formability are sometimes deteriorated.

The ink-receiving layer on the gloss surface side and the ink-receiving layer on the side opposite to the gloss surface side are provided by coating a coating solution on the support and drying the coat. For coating the coating solution, there may be used various coating devices on-machine or off-machine, such as various blade coaters, roll coaters, air knife coaters, bar coaters, rod blade coaters, curtain coaters, short dwell coaters, and size press. Of these coating devices, air knife coaters and curtain coaters are preferred. The dry coating amount of each ink-receiving layer is optionally selected within the range of usually 1–50 g/m$^2$.

The construction of the ink-receiving layer constituting the gloss surface side may be a single layer construction comprising a gloss developing layer designed so as to develop gloss or a multi-layer construction for improving absorption of ink, color formability, weathering resistance, or the like. As the multi-layer construction, preferred is one which comprises an ink-absorbing layer mainly composed of an inorganic pigment and a binder and a gloss developing layer provided on the ink-absorbing layer. Furthermore, the ink-receiving layer on the side opposite to the gloss surface side also preferably has a construction mainly composed of an inorganic pigment and a binder or a construction comprising additionally a gloss developing layer.

As the pigments used in the ink-absorbing layer or the gloss developing layer on the gloss surface side and the ink-receiving layer on the side opposite to the gloss surface side, there may be used one or more known inorganic pigments. Examples of the pigments are alkaline earth metal salts such as calcium carbonate, calcium sulfate, calcium silicate, magnesium carbonate, magnesium silicate, and barium sulfate, and white inorganic pigments such as kaolin, talc, titanium dioxide, zinc oxide, zinc sulfide, zinc carbonate, satin white, aluminum silicate, diatomaceous earth, synthetic amorphous silica, colloidal silica, alumina, colloidal alumina, pseudoboehmite, aluminum hydroxide, lithopone, zeolite, hydrated halloysite, etc. Among them, porous pigments such as synthetic amorphous silica are preferred from the viewpoint of ink absorption. Furthermore, the alkaline earth metal salts are also preferred, and calcium carbonate is especially preferred. The amount of the inorganic pigments added is optionally selected within the range of 10–98% in weight ratio based on the whole ink-receiving layer.

As the binders used for the ink-absorbing layer or the gloss developing layer on the gloss surface side and the ink-receiving layer on the side opposite to the gloss surface side, mention may be made of, for example, aqueous adhesives, e.g., starch derivatives such as oxidized starch, etherified starch and phosphoric acid-esterified starch, cellulose derivatives such as carboxymethyl cellulose and hydroxyethyl cellulose, casein, gelatin, soybean protein, polyvinyl alcohol, polyvinyl alcohol or derivatives thereof, polyvinyl pyrrolidone, maleic anhydride resin, conjugated diene copolymer latexes such as styrene-butadiene copolymer and methyl-methacrylate-butadiene copolymer, acrylic polymer latexes, e.g., acrylic polymers such as polymers or copolymers of acrylate ester and methacrylate ester, vinyl polymer latexes such as ethylene-vinyl acetate copolymer, functional group-modified polymer latexes of the above various polymers modified with monomers containing functional groups such as carboxyl group, and thermosetting synthetic resins such as melamine resin and urea resin, and synthetic resin adhesives, e.g., polymer or copolymer resins of acrylate esters and methacrylate esters such as polymethyl methacrylate, polyurethane resin, unsaturated polyester resin, vinyl chloride-vinyl acetate copolymer, polyvinyl butyral, and alkyd resins. The amount of the binder is 2–70%, preferably 4–50% by weight ratio based on the whole ink-receiving layer. If the amount is less than 2%, the coating layer strength of the ink-receiving layer is sometimes insufficient, and if it exceeds 70%, ink absorbability is sometimes deteriorated.

Furthermore, the ink-absorbing layer or the gloss developing layer on the gloss surface side and the ink-receiving layer on the side opposite to the gloss surface side may optionally contain additives such as dye fixing agents, pigment dispersing agents, thickening agents, fluidity improving agents, anti-foaming agents, foam inhibitors, releasing agents, foaming agents, penetrants, colored dyes, colored pigments, fluorescent brighteners, ultraviolet absorbers, antioxidants, preservatives, antifungal agents, water resisting agents, dry strengthening agents, wet strengthening agents, etc.

Especially, by adding a cationic dye fixing agent comprising a secondary amine, tertiary amine or quaternary ammonium salt which forms an insoluble salt with sulfone group, carboxyl group, amino group, or the like in water-soluble direct dyes or water-soluble acid dyes which are dye components of aqueous inks, the dye is captured in the ink-receiving layer, and, hence, color formability is improved and furthermore owing to the formation of water-insoluble salt, ink is inhibited from flowing or blotting caused by dropping of water or absorption of moisture. Thus, addition of the cationic dye fixing agent is preferred.

The ink-absorbing layer on the gloss surface side and the ink-receiving layer on the side opposite to the gloss surface side may be subjected to aftertreatments by various calendering devices to control the flattening.

The gloss surface of the present invention can be obtained by carrying out gloss developing treatments such as drying treatments, e.g., heat drying with hot air generally used for drying of coating layer and low-temperature setting drying including cooling zone, smoothing treatments by various calendering devices, pressure-contact specular finishing by cast-coating method, etc. after coating the coating solution for the gloss developing layer by various coating devices. The method for developing gloss is not particularly limited. Among the above treatments, it is preferred to use the pressure-contact specular finishing by cast-coating method which can readily give high gloss feeling and good ink absorption. Moreover, for the smoothing treatment by calendering devices, there can be used calendering devices such as machine calender, TG calender, super calender, and soft calender, and the super calender is preferred. Surface roughness, surface temperature, diameter, pressure at treatment (linear pressure), treating speed, etc. of the roll of the calendering devices can be optionally selected. Furthermore, in order to optimize gloss feeling and suitability for ink jet recording, these gloss developing treatments may be carried out in combination.

For obtaining photographic feeling, it is necessary that the gloss surface has a 75° specular glossiness of not less than 40% measured in accordance with JIS Z8741. If the glossiness is lower than 40%, the gloss feeling is inferior and such glossiness is not preferred. Further, in the case of double-side ink jet recording sheets having gloss surface obtained by pressure-contact specular finishing by conventional cast-coating method, the gloss surface tends to be seriously damaged by rubbing although the glossiness is high. According to the present invention, by employing a 75° specular glossiness of the gloss surface of not less than 70%, both the very high gloss feeling and the inhibition of damage of the gloss surface can be attained without causing deterioration of ink absorption of the gloss surface side.

The pressure-contact specular finishing by cast-coating method as a gloss developing treatment includes direct method, solidification method, re-wetting method, etc. This is a method which comprises coating a coating solution for gloss developing layer, contacting the surface of the coat with a heated specular roll and pressing them while the surface of the coat is in wet state, followed by drying and peeling to form a replica of the surface of the specular roll on the surface of the coat. The direct method comprises coating the coating solution, pressure-contacting the coat in undried state (wet state) with a heated specular roll, and then drying the coat, and the solidification method comprises coating the coating solution, solidifying the coat with an acid solution, an alkali solution or the like, and pressure-contacting the solidified coat with a specular roll. The solidification method also includes a hot solidification method which comprises irradiating the coat with infrared rays to solidify the surface. The re-wetting method comprises coating and drying the coating solution, then re-wetting the coat with a liquid mainly composed of water, and pressure-contacting it with a heated specular surface.

All of these pressure-contact specular finishing methods by the cast-coating method can be applied to the double-side ink jet recording sheet of the present invention. Furthermore, surface roughness, surface temperature, diameter, pressure at pressure-contacting (linear pressure), and coating speed of the specular roll can be optionally selected as in production of commercially available cast-coated papers.

When a salt of an alkaline earth metal is used as the pigment used in the ink-absorbing layer, both the good gloss feeling and ink absorption can be attained by using the drying treatment as the gloss developing treatment of the gloss developing layer. It is considered that this is probably because when the pigment in the ink-absorbing layer is a salt of alkaline earth metal and especially when the coating solution for the gloss developing layer is acidic, the acid in the coating solution for the gloss developing layer and the salt of alkaline earth metal give a shock at the time of coating of the gloss developing layer, and the coating solution for the gloss developing layer does not permeate the ink-absorbing layer to form an interface and a highly smooth surface is formed due to leveling and is dried. It is also considered that during or after the drying, the salt of alkaline earth metal at the interface or in the ink-receiving layer is gradually dissolved or modified with water, acid or the like in the ink-receiving layer to form an absorption route, and, as a result, the absorbability of the ink-absorbing layer links with the pores of the gloss developing layer to enhance the ink absorbability. Therefore, it is preferred that the coating solution for the gloss developing layer is in the acidic area. The coating solution for the gloss developing layer has a pH of preferably 5.0 or lower, especially preferably 4.0 or lower. After being subjected to the gloss developing treatment by drying treatment, the gloss developing layer may further be subjected to smoothing treatment by various calendering devices or gloss developing treatment by casting method.

The outermost layer of the ink-receiving layer which constitutes the gloss surface side, namely, the gloss developing layer is required to have gloss developing ability given by drying treatment, smoothing treatment by a calendering device and pressure-contact specular finishing by cast-coating method and, in addition, properties such as ink absorption and color formation. For satisfying these conditions, preferred is a constitution mainly composed of ultrafine particles of less than 1 μm in average particle diameter and a binder. The ultrafine particles include inorganic ultrafine particles such as colloidal silica, amorphous synthetic silica produced by a gas phase method and an alumina compound and organic ultrafine particles such as polystyrene, methyl methacrylate, styrene-butadiene copolymer, methyl methacrylate-butadiene copolymer, acrylate ester and methacrylate ester copolymers, urea resin, and melamine resin. These may be used each alone or in combination of two or more, or in combination with pigments having an average particle diameter of not less than 1 μm. When pressure-contact specular finishing by cast-coating method is employed as the gloss developing treatment, the ultrafine particles in the gloss developing layer are preferably those which especially have a cationic property, namely, cation-modified colloidal silica, alumina and alumina hydrate. In the case of the pigment in the ink-absorbing layer being a salt of alkaline earth metal, amorphous synthetic silica produced by a gas phase method or an alumina compound is preferred as the ultrafine particles in the gloss developing layer in order to easily conduct the adjustment of pH of the coating solution for the gloss developing layer.

Papers used as a support include, for example, base papers made from a mixture of a wood pulp, e.g., chemical pulp such as LBKP or NBKP, a mechanical pulp such as GP, PGW, RMP, TMP, CTMP, CMP or CGP, a waste-paper pulp such as DIP and a known pigment as main components and, furthermore, at least one of various additives such as a binder, a sizing agent, a fixing agent, a yield improving agent, a cationizing agent and a strengthening agent, using various paper making machines such as Fourdrinier paper machine, twin-wire paper machine and cylinder paper machine, these base papers size-press coated with starch, polyvinyl alcohol or the like or provided with an anchor-coat layer, and coated papers prepared by providing a coat layer on the base papers, such as art papers, coated papers and cast-coated papers. The coat layers of the present invention may be coated on the above base papers or coated papers as they are, or for controlling the flattening, there may be used calendering devices such as machine calender, TG calender and soft calender. Furthermore, the basis weight of the support is usually 40–300 g/m$^2$, but is not particularly limited.

The present invention will be explained by the following examples, which should not be construed as limiting the invention in any manner. "Part" and "%" in the examples are part by weight and % by weight.

A slurry of 1% in solid concentration was prepared which contained in water 100 parts of wood pulp comprising 80 parts of LBKP (freeness: 400 ml csf) and 20 parts of NBKP (freeness: 450 ml csf) and 25 parts of pigments comprising precipitated calcium carbonate/heavy calcium carbonate/talc at a ratio of 10/10/10, 0.10 part of commercially available alkyl ketene dimer, 0.03 part of commercially available cationic (meth)acrylamide, 0.80 part of commercially available cationized starch and 0.40 part of aluminum sulfate. The resulting slurry was subjected to paper making process using a Fourdrinier paper machine to make a support having a basis weight of 90 g/m$^2$.

The following coating solution (a) for gloss developing layer was coated on the support at a dry coating amount of 15 g/m$^2$ by an air knife coater, and the coat in wet state was subjected to pressure-contact specular finishing by cast-coating method using a drum having specular surface at 100° C. to prepare a one-side gloss paper 1.

<Coating Solution (a) for Gloss Developing Layer>

| | |
|---|---|
| Water | 200 parts |
| Colloidal silica (ST-XL: manufactured by Nissan Chemical Co., Ltd.; average particle diameter: 40–60 nm; concentration: 40%) | 250 parts |
| Styrene-butadiene latex (0691: manufactured by JSR Co., Ltd.; concentration: 48%) | 63 parts |
| Stearic acid (SELOSOL 920: manufactured by Chukyo Yushi Co., Ltd.; concentration: 18%) | 17 parts |

EXAMPLE 1

The following coating solution for ink-receiving layer was coated on the uncoated side of the above one-side gloss paper 1 at a dry coating amount of 10 g/m$^2$ by an air knife coater and dried to prepare an ink jet recording sheet of Example 1.

<Coating Solution for Ink-receiving Layer>

| | |
|---|---|
| Water | 450 parts |
| Porous synthetic amorphous silica (FINESIL X37B: manufactured by Tokuyama Co., Ltd.) | 100 parts |
| 10% aqueous polyvinyl alcohol solution (PVA 117: manufactured by Kuraray Co., Ltd.) | 300 parts |
| Cationic dye fixing agent (SUMIREZ RESIN 1001: manufactured by Sumitomo Chemical Co., Ltd.; concentration: 30%) | 67 parts |
| Aqueous polyolefin dispersion (CHEMIPEARL W310: manufactured by Mitsui Chemical Co., Ltd.; true spherical form; average particle diameter: 9.5 μm; concentration: 40%) | 50 parts |

The following coating solution A for ink-absorbing layer was coated on the support at a dry coating amount of 10 g/m$^2$ by an air knife coater and dried. Then, on the above layer was coated the following coating solution (b) for gloss developing layer at a dry coating amount of 8 g/m$^2$ by an air knife coater, and the coat in wet state was subjected to pressure-contact specular finishing by cast-coating method using a drum having specular surface at 100° C. to prepare a one-side gloss paper 2.

<Coating Solution A for Ink-absorbing Layer>

| | |
|---|---|
| Water | 450 parts |
| Porous synthetic amorphous silica (FINESIL X37B: manufactured by Tokuyama Co., Ltd.) | 100 parts |
| 10% Aqueous polyvinyl alcohol solution (PVA 117: manufactured by Kuraray Co., Ltd.) | 300 parts |
| Cationic dye fixing agent (SUMIREZ RESIN 1001: manufactured by Sumitomo Chemical Co., Ltd.; concentration: 30%) | 67 parts |

<Coating Solution (b) for Gloss Developing Layer>

| | |
|---|---|
| Cation-modified colloidal silica (ST-AK: manufactured by Nissan Chemical Co., Ltd.; average particle diameter: 10–20 nm; concentration: 20%) | 250 parts |

-continued

| | |
|---|---|
| Alumina sol (AS-3: manufactured by Shokubai Kasei Co., Ltd.; average particle diameter: 10 × 100 nm (rod-like); concentration: 7%) | 714 parts |
| Styrene-butadiene latex (0693: manufactured by JSR Co., Ltd.; concentration: 48%) | 52 parts |
| Stearic acid (SELOSOL 920: manufactured by Chukyo Yushi Co., Ltd.; concentration: 18%) | 17 parts |

EXAMPLE 2

The above coating solution for ink-receiving layer was coated on the uncoated side of the above one-side gloss paper 2 at a dry coating amount of 10 g/m$^2$ by an air knife coater and dried to prepare an ink jet recording sheet of Example 2.

EXAMPLE 3

An ink jet recording sheet of Example 3 was prepared in the same manner as in Example 2, except that the amount of the aqueous polyolefin dispersion (CHEMIPEARL W310) was changed to 20 parts.

EXAMPLE 4

An ink jet recording sheet of Example 4 was prepared in the same manner as in Example 2, except that the amount of the aqueous polyolefin dispersion (CHEMIPEARL W310) was changed to 125 parts.

EXAMPLE 5

An ink jet recording sheet of Example 5 was prepared in the same manner as in Example 2, except that 50 parts of an aqueous polyolefin dispersion (CHEMIPEARL W300: manufactured by Mitsui Chemical Co., Ltd.; true spherical form; average particle diameter: 3 μm; concentration: 40%) was used in place of 50 parts of the aqueous polyolefin dispersion (CHEMIPEARL W310).

EXAMPLE 6

An ink jet recording sheet of Example 6 was prepared in the same manner as in Example 2, except that 50 parts of an aqueous polyolefin dispersion (CHEMIPEARL M200: manufactured by Mitsui Chemical Co., Ltd.; true spherical form; average particle diameter: 6 μm; concentration: 40%) was used in place of 50 parts of the aqueous polyolefin dispersion (CHEMIPEARL W310).

EXAMPLE 7

An ink jet recording sheet of Example 7 was prepared in the same manner as in Example 2, except that 20 parts of rice starch (MICROPEARL: manufactured by Shimada Chemical Co., Ltd.; particle diameter: 2–8 μm) was used in place of 50 parts of the aqueous polyolefin dispersion (CHEMIPEARL W310).

EXAMPLE 8

An ink jet recording sheet of Example 8 was prepared in the same manner as in Example 2, except that 20 parts of polymethyl methacrylate particles (MB-8: manufactured by Sekisui Kaseihin Co., Ltd.; average particle diameter: 8 μm) were used in place of 50 parts of the aqueous polyolefin dispersion (CHEMIPEARL W310).

EXAMPLE 9

An ink jet recording sheet of Example 9 was prepared in the same manner as in Example 2, except that 20 parts of cross-linked polystyrene particles (SBX-8: manufactured by Sekisui Kaseihin Co., Ltd.; average particle diameter: 8 μm) were used in place of 50 parts of the aqueous polyolefin dispersion (CHEMIPEARL W310).

EXAMPLE 10

An ink jet recording sheet of Example 10 was prepared in the same manner as in Example 2, except that 20 parts of cross-linked polymethyl methacrylate particles (MBX-20: manufactured by Sekisui Kaseihin Co., Ltd.; average particle diameter: 20 μm) were used in place of 50 parts of the aqueous polyolefin dispersion (CHEMIPEARL W310).

EXAMPLE 11

An ink jet recording sheet of Example 11 was prepared in the same manner as in Example 2, except that 25 parts of the aqueous polyolefin dispersion (CHEMIPEARL W310) and 10 parts of rice starch (MICROPEARL: manufactured by Shimada Chemical Co., Ltd.; particle diameter: 2–8 μm) were used in place of 50 parts of the aqueous polyolefin dispersion (CHEMIPEARL W310).

EXAMPLE 12

An ink jet recording sheet of Example 12 was prepared in the same manner as in Example 2, except that 50 parts of an aqueous dispersion of a vinyl acetate-based copolymer compound (CHEMIPEARL V300: manufactured by Mitsui Chemical Co., Ltd.; true spherical form; average particle diameter: 6 μm; concentration: 40%) was used in place of 50 parts of the aqueous polyolefin dispersion (CHEMIPEARL W310).

EXAMPLE 13

The above coating solution A for ink-absorbing layer and the following coating solution (c) for gloss developing layer were consecutively coated on the uncoated side of the one-side gloss paper 2 at dry coating amounts of 10 g/m$^2$ and 8 g/m$^2$, respectively by an air knife coater and dried, followed by carrying out smoothing treatment at a linear pressure of 120 kN/m by a super calendering device to prepare an ink jet recording sheet of Example 13. The surface coated with the coating solution A for the ink-absorbing layer and the coating solution (c) for gloss developing layer had a 75° gloss of 55% after subjected to the smoothing treatment.

<Coating Solution (c) for Gloss Developing Layer>

| | |
|---|---|
| Cation-modified colloidal silica (ST-AK: manufactured by Nissan Chemical Co., Ltd.; concentration: 20%) | 250 parts |
| Alumina sol (AS-3: manufactured by Shokubai Kasei Co., Ltd.; concentration: 7%) | 714 parts |

-continued

| | |
|---|---|
| Styrene-butadiene latex (0693: manufactured by JSR Co., Ltd.; concentration: 40%) | 25 parts |
| 10% Aqueous polyvinyl alcohol solution (PVA205: manufactured by Kuraray Co., Ltd.) | 100 parts |
| Rice starch (MICROPEARL: manufactured by Shimada Chemical Co., Ltd.; particle diameter: 2–8 μm) | 10 parts |

COMPARATIVE EXAMPLE 1

An ink jet recording sheet of Comparative Example 1 was prepared in the same manner as in Example 1, except that 50 parts of the aqueous polyolefin dispersion (CHEMIPEARL W310) was not added.

COMPARATIVE EXAMPLE 2

An ink jet recording sheet of Comparative Example 2 was prepared in the same manner as in Example 2, except that 50 parts of the aqueous polyolefin dispersion (CHEMIPEARL W310) was not added.

COMPARATIVE EXAMPLE 3

An ink jet recording sheet of Comparative Example 3 was prepared in the same manner as in Example 2, except that 20 parts of polymethyl methacrylate particles (MB-50: manufactured by Sekisui Kaseihin Co., Ltd.; average particle diameter: 50 μm) were used in place of 50 parts of the aqueous polyolefin dispersion (CHEMIPEARL W310).

COMPARATIVE EXAMPLE 4

An ink jet recording sheet of Comparative Example 4 was prepared in the same manner as in Example 2, except that 50 parts of an aqueous polyolefin dispersion (CHEMIPEARL W700: manufactured by Mitsui Chemical Co., Ltd.; average particle diameter: 1 μm; concentration: 40%) was used in place of 50 parts of the aqueous polyolefin dispersion (CHEMIPEARL W310).

COMPARATIVE EXAMPLE 5

An ink jet recording sheet of Comparative Example 5 was prepared in the same manner as in Example 13, except that 10 parts of rice starch (MICROPEARL) was not added.

The above coating solution A for ink-absorbing layer and the following coating solution (d) for gloss developing layer were consecutively coated on the support at dry coating amounts of 10 g/m$^2$ and 8 g/m$^2$, respectively by an air knife coater and dried, followed by carrying out smoothing treatment at a linear pressure of 120 kN/m by a super calendering device to prepare a one-side gloss paper 3.

<Coating Solution (d) for Gloss Developing Layer>

| | |
|---|---|
| Cation-modified colloidal silica (ST-AK: manufactured by Nissan Chemical Co., Ltd.; concentration: 20%) | 250 parts |
| Alumina sol (AS-3: manufactured by Shokubai Kasei Co., Ltd.; concentration: 7%) | 714 parts |
| Styrene-butadiene latex (0693: manufactured by JSR Co., Ltd.; concentration: 48%) | 21 parts |

-continued

| | |
|---|---|
| 10% Aqueous polyvinyl alcohol solution (PVA205: manufactured by Kuraray Co., Ltd.) | 100 parts |

EXAMPLE 14

The above coating solution for ink-receiving layer was coated on the uncoated side of the one-side gloss paper 3 at a dry coating amount of 10 g/m$^2$ by an air knife coater and dried to prepare an ink jet recording sheet of Example 14.

EXAMPLE 15

An ink jet recording sheet of Example 15 was prepared in the same manner as in Example 14, except that 20 parts of rice starch (MICROPEARL: manufactured by Shimada Chemical Co., Ltd.; particle diameter: 2–8 μm) was used in place of 50 parts of the aqueous polyolefin dispersion (CHEMIPEARL W310).

EXAMPLE 16

An ink jet recording sheet of Example 16 was prepared in the same manner as in Example 14, except that 20 parts of polymethyl methacrylate particles (MB-8: manufactured by Sekisui Kaseihin Co., Ltd.; average particle diameter: 8 μm) were used in place of 50 parts of the aqueous polyolefin dispersion (CHEMIPEARL W310).

EXAMPLE 17

An ink jet recording sheet of Example 17 was prepared in the same manner as in Example 14, except that 20 parts of cross-linked polystyrene particles (SBX-8: manufactured by Sekisui Kaseihin Co., Ltd.; average particle diameter: 8 μm) were used in place of 50 parts of the aqueous polyolefin dispersion (CHEMIPEARL W310).

EXAMPLE 18

An ink jet recording sheet of Example 18 was prepared in the same manner as in Example 14, except that 20 parts of cross-linked polymethyl methacrylate particles (MBX-20: manufactured by Sekisui Kaseihin Co., Ltd.; average particle diameter: 20 μm) were used in place of 50 parts of the aqueous polyolefin dispersion (CHEMIPEARL W310).

EXAMPLE 19

An ink jet recording sheet of Example 19 was prepared in the same manner as in Example 14, except that 50 parts of an aqueous dispersion of a vinyl acetate-based copolymer compound (CHEMIPEARL V300: manufactured by Mitsui Chemical Co., Ltd.; true spherical form; average particle diameter: 6 μm; concentration: 40%) was used in place of 50 parts of the aqueous polyolefin dispersion (CHEMIPEARL W310).

COMPARATIVE EXAMPLE 6

An ink jet recording sheet of Comparative Example 6 was prepared in the same manner as in Example 14, except that 50 parts of the aqueous polyolefin dispersion (CHEMIPEARL W310) was not added.

COMPARATIVE EXAMPLE 7

An ink jet recording sheet of Comparative Example 7 was prepared in the same manner as in Example 14, except that 20 parts of polymethyl methacrylate particles (MB-50: manufactured by Sekisui Kaseihin Co., Ltd.; average particle diameter: 50 μm) were used in place of 50 parts of the aqueous polyolefin dispersion (CHEMIPEARL W310).

COMPARATIVE EXAMPLE 8

An ink jet recording sheet of Comparative Example 8 was prepared in the same manner as in Example 14, except that 50 parts of an aqueous polyolefin dispersion (CHEMIPEARL W700: manufactured by Mitsui Chemical Co., Ltd.; average particle diameter: 1 μm; concentration: 40%) was used in place of 50 parts of the aqueous polyolefin dispersion (CHEMIPEARL W310).

The following coating solution B for ink-absorbing layer was coated on the support at a dry coating amount of 15 g/m$^2$ by a rod bar coater and dried, and thereafter the following coating solution (e) for gloss developing layer was coated thereon at a dry coating amount of 15 g/m$^2$ by a curtain coater and dried by a hot air dryer to prepare a one-side gloss paper 4. The coating solution (e) for gloss developing layer had a pH of 3.8.

<Coating Solution B for Ink-absorbing Layer>

| | |
|---|---|
| Water | 125 parts |
| Precipitated calcium carbonate (TAMAPEARL TP-222H: manufactured by Okutama Kogyo Co., Ltd.) | 100 parts |
| Styrene-butadiene latex (0693: manufactured by JSR Co., Ltd.; concentration: 48%) | 42 parts |

<Coating Solution (e) for Gloss Developing Layer>

| | |
|---|---|
| Water | 800 parts |
| Silica obtained by gas phase method (AEROSIL 300: manufactured by Japan Aerosil Co., Ltd.; average particle diameter: 7 nm) | 100 parts |
| Dispersing agent (SHALLOL DC902P: manufactured by Daiichi Kogyo Seiyaku Co., Ltd.) | 3 parts |
| 10% Aqueous polyvinyl alcohol solution (PVA105: manufactured by Kuraray Co., Ltd.) | 100 parts |

A one-side gloss paper 5 was prepared in the same manner as in preparation of the one-side gloss paper 4, except that pH of the coating solution (e) for gloss developing layer was adjusted to 4.6 by adding sodium hydroxide to the coating solution.

A one-side gloss paper 6 was prepared in the same manner as in preparation of the one-side gloss paper 4, except that pH of the coating solution (e) for gloss developing layer was adjusted to 5.5 by adding sodium hydroxide to the coating solution.

The following coating solution C for ink-absorbing layer was coated on the support at a dry coating amount of 10 g/m$^2$ by a rod bar coater and dried, and thereafter the following coating solution (f) for gloss developing layer was coated thereon at a dry coating amount of 10 g/m$^2$ by a curtain coater and dried by a hot air dryer to prepare a one-side gloss paper 7. The coating solution (f) for gloss developing layer had a pH of 3.6.

<Coating Solution C for Ink-absorbing Layer>

| | |
|---|---|
| Water | 100 parts |
| Precipitated calcium carbonate (TAMAPEARL TP-123: manufactured by Okutama Kogyo Co., Ltd.) | 70 parts |
| Kaolin (KAOBRIGHT: manufactured by Shiraishi Calcium Co., Ltd.) | 30 parts |
| Styrene-butadiene latex (PA-0139: manufactured by Japan A & L Co., Ltd.; concentration: 50%) | 20 parts |
| 10% aqueous phosphoric acid esterified starch solution (MS4600: manufactured by Nihon Shokuhin Kako Co., Ltd.) | 30 parts |

<Coating Solution (f) for Gloss Developing Layer>

| | |
|---|---|
| Alumina sol (AS-2: manufactured by Shokubai Kasei Co., Ltd.; average particle diameter: 10 × 100 nm rod-like); concentration: 10%) | 1000 parts |
| 10% Aqueous polyvinyl alcohol solution (PVA235: manufactured by Kuraray Co., Ltd.) | 150 parts |

The gloss surface of the one-side gloss paper 7 was subjected to smoothing treatment at a linear pressure of 100 kN/m using a super calendering device to prepare a one-side gloss paper 8.

EXAMPLE 20

The above coating solution for ink-receiving layer was coated on the uncoated side of the one-side gloss paper 4 at a dry coating amount of 10 g/m$^2$ by an air knife coater and dried to prepare an ink jet recording sheet of Example 20.

EXAMPLE 21

An ink jet recording sheet of Example 21 was prepared in the same manner as in Example 20, except that 20 parts of rice starch (MICROPEARL: manufactured by Shimada Chemical Co., Ltd.; particle diameter: 2–8 μm) was used in place of 50 parts of the aqueous polyolefin dispersion (CHEMIPEARL W310).

EXAMPLE 22

An ink jet recording sheet of Example 22 was prepared in the same manner as in Example 20, except that 20 parts of polymethyl methacrylate particles (MB-8: manufactured by Sekisui Kaseihin Co., Ltd.; average particle diameter: 8 μm) were used in place of 50 parts of the aqueous polyolefin dispersion (CHEMIPEARL W310).

EXAMPLE 23

An ink jet recording sheet of Example 23 was prepared in the same manner as in Example 20, except that 20 parts of cross-linked polystyrene particles (SBX-8: manufactured by Sekisui Kaseihin Co., Ltd.; average particle diameter: 8 μm) were used in place of 50 parts of the aqueous polyolefin dispersion (CHEMIPEARL W310).

EXAMPLE 24

An ink jet recording sheet of Example 24 was prepared in the same manner as in Example 20, except that 20 parts of cross-linked polymethyl methacrylate particles (MBX-20:

manufactured by Sekisui Kaseihin Co., Ltd.; average particle diameter: 20 μm) were used in place of 50 parts of the aqueous polyolefin dispersion (CHEMIPEARL W310).

EXAMPLE 25

An ink jet recording sheet of Example 25 was prepared in the same manner as in Example 20, except that 50 parts of an aqueous dispersion of a vinyl acetate-based copolymer compound (CHEMIPEARL V300: manufactured by Mitsui Chemical Co., Ltd.; true spherical form; average particle diameter: 6 μm; concentration: 40%) was used in place of 50 parts of the aqueous polyolefin dispersion (CHEMIPEARL W310).

EXAMPLE 26

The above coating solution for ink-receiving layer was coated on the uncoated side of the one-side gloss paper 5 at a dry coating amount of 10 g/m$^2$ by an air knife coater and dried to prepare an ink jet recording sheet of Example 26.

EXAMPLE 27

The above coating solution for ink-receiving layer was coated on the uncoated side of the one-side gloss paper 6 at a dry coating amount of 10 g/m$^2$ by an air knife coater and dried to prepare an ink jet recording sheet of Example 27.

EXAMPLE 28

The above coating solution for ink-receiving layer was coated on the uncoated side of the one-side gloss paper 7 at a dry coating amount of 10 g/m$^2$ by an air knife coater and dried to prepare an ink jet recording sheet of Example 28.

EXAMPLE 29

The above coating solution for ink-receiving layer was coated on the uncoated side of the one-side gloss paper 8 at a dry coating amount of 10 g/m$^2$ by an air knife coater and dried to prepare an ink jet recording sheet of Example 29.

EXAMPLE 30

The above coating solution C for ink-absorbing layer was coated on the support at a dry coating amount of 10 g/m$^2$ by a rod bar coater and dried, and thereafter the following coating solution (g) for gloss developing layer was coated thereon at a dry coating amount of 10 g/m$^2$ by a curtain coater and dried by a hot air dryer to prepare a one-side gloss paper 9. Furthermore, the above coating solution C for ink-absorbing layer was coated on the uncoated side of the one-side gloss paper 9 at a dry coating amount of 10 g/m$^2$ by a rod bar coater and dried, and thereafter the following coating solution (g) for gloss developing layer was coated thereon at a dry coating amount of 10 g/m$^2$ by a curtain coater and dried by a hot air dryer to prepare an ink jet recording sheet of Example 30. The coating solution (g) for gloss developing layer had a pH of 3.9. The side which was opposite to the gloss surface side and was coated later with the coating solution C for the ink-absorbing layer and the coating solution (g) for gloss developing layer had a 75° specular glossiness of 51%.

<Coating Solution (g) for Gloss Developing Layer>

| | |
|---|---|
| Alumina sol (AS-2: manufactured by Shokubai Kasei Co., Ltd.; concentration: 10%) | 1000 parts |
| 10% Aqueous polyvinyl alcohol solution (PVA235: manufactured by Kuraray Co., Ltd.) | 150 parts |
| Aqueous polyolefin dispersion (CHEMIPEARL W308: manufactured by Mitsui Chemical Co., Ltd.; true spherical form; average particle diameter: 7 μm; concentration: 40%) | 25 parts |

COMPARATIVE EXAMPLE 9

An ink jet recording sheet of Comparative Example 9 was prepared in the same manner as in Example 20, except that 50 parts of the aqueous polyolefin dispersion (CHEMIPEARL W310) was not added.

COMPARATIVE EXAMPLE 10

An ink jet recording sheet of Comparative Example 10 was prepared in the same manner as in Example 20, except that 20 parts of polymethyl methacrylate particles (MB-50: manufactured by Sekisui Kaseihin Co., Ltd.; average particle diameter: 50 μm) were used in place of 50 parts of the aqueous polyolefin dispersion (CHEMIPEARL W310).

COMPARATIVE EXAMPLE 11

An ink jet recording sheet of Comparative Example 11 was prepared in the same manner as in Example 20, except that 50 parts of an aqueous polyolefin dispersion (CHEMIPEARL W700: manufactured by Mitsui Chemical Co., Ltd.; average particle diameter: 1 μm; concentration: 40%) was used in place of 50 parts of the aqueous polyolefin dispersion (CHEMIPEARL W310).

COMPARATIVE EXAMPLE 12

An ink jet recording sheet of Comparative Example 12 was prepared in the same manner as in Example 28, except that 50 parts of the aqueous polyolefin dispersion (CHEMIPEARL W310) was not added.

COMPARATIVE EXAMPLE 13

An ink jet recording sheet of Comparative Example 13 was prepared in the same manner as in Example 29, except that 50 parts of the aqueous polyolefin dispersion (CHEMIPEARL W310) was not added.

COMPARATIVE EXAMPLE 14

An ink jet recording sheet of Comparative Example 14 was prepared in the same manner as in Example 30, except that 25 parts of the aqueous polyolefin dispersion (CHEMIPEARL W308) was not added to the gloss side and the side opposite to the gloss side.

The ink jet recording sheets of the above examples and comparative examples were evaluated on the following properties, and the results are shown in Table 1, Table 2 and Table 3.

GLOSSINESS

The 75° specular glossiness of the unprinted portion of the gloss surface side was measured in accordance with JIS Z8741 by a varied-angle gloss meter (VGS-1001DP) manufactured by Nihon Denshoku Kogyo Co., Ltd.

The scratch was evaluated by cutting the produced sheet to a size of A4, setting 20 sheets of A4 size in an ink jet printer PM-900C manufactured by Seiko-Epson Co., Ltd., carrying out continuous printing on the side opposite to the gloss side, and then visually observing the scratches on the gloss side. The mark "◎" means that substantially no scratches are seen and the sheet is especially good, "○" means that slight scratches are seen, but the sheet is good, "Δ" means that considerable scratches are seen, but the sheet is usable, and "×" means that scratches are serious and the sheet is practically unacceptable.

Evaluation of the ink jet recording characteristics was conducted by printing images on the gloss side and the side opposite to the gloss side of the produced sheet using an ink jet printer PM-900C manufactured by Seiko-Epson Co., Ltd. [setting: super fine paper, "Kirei" (Beautiful)]. The images used for the evaluation included 100% solid print portions of black, cyan, magenta, yellow, blue, red and green, respectively, and patterns of these solid print portions in which white void letters were prepared. The ink absorbability was evaluated by visually observing uniformity of the solid print portions, and sharpness of the boundary of adjacent solid print portions and the white void letters. The mark "○" means that the ink absorbability is good, "Δ" means that some ununiformity in the solid print portions is seen which is caused by inferior ink absorbability or the white void letters are blurred and thus the ink absorbability is somewhat inferior to the ink absorbability indicated by "○", but has practically no problems, and "×" means that the ink absorbability is practically unacceptable.

The color formability was evaluated by measuring the optical density of 100% black solid print portions using Macbeth densitometer "TR-924". When the color formability is less than 1.50, images are insufficient in sharpness particularly in the case of printing a photograph, and a color formability of 1.60 or more is especially good.

TABLE 1

| | Gloss side | | | The opposite side | |
|---|---|---|---|---|---|
| No. | Glossiness | Scratch | Ink absorbability | Ink absorbability | Color formability |
| Example 1 | 63 | ◎ | Δ | ○ | 1.65 |
| Example 2 | 77 | ◎ | ○ | ○ | 1.66 |
| Example 3 | 78 | ○ | ○ | ○ | 1.67 |
| Example 4 | 78 | ◎ | ○ | Δ | 1.53 |
| Example 5 | 77 | ◎ | ○ | ○ | 1.66 |
| Example 6 | 76 | ◎ | ○ | ○ | 1.64 |
| Example 7 | 76 | ○ | ○ | ○ | 1.68 |
| Example 8 | 78 | ○ | ○ | ○ | 1.67 |
| Example 9 | 78 | ○ | ○ | ○ | 1.65 |
| Example 10 | 77 | ○ | ○ | ○ | 1.62 |
| Example 11 | 76 | ◎ | ○ | ○ | 1.68 |
| Example 12 | 76 | Δ | ○ | Δ | 1.51 |
| Example 13 | 77 | ○ | ○ | ○ | 1.83 |
| Comparative Example 1 | 62 | X | Δ | ○ | 1.65 |
| Comparative Example 2 | 78 | X | ○ | ○ | 1.64 |
| Comparative Example 3 | 77 | X | ○ | Δ | 1.45 |

TABLE 1-continued

| | Gloss side | | | The opposite side | |
|---|---|---|---|---|---|
| No. | Glossiness | Scratch | Ink absorbability | Ink absorbability | Color formability |
| Comparative Example 4 | 77 | X | ○ | Δ | 1.62 |
| Comparative Example 5 | 76 | X | ○ | ○ | 1.84 |

TABLE 2

| | Gloss side | | | The opposite side | |
|---|---|---|---|---|---|
| No. | Glossiness | Scratch | Ink absorbability | Ink absorbability | Color formability |
| Example 14 | 58 | ◎ | ○ | ○ | 1.66 |
| Example 15 | 56 | ○ | ○ | ○ | 1.67 |
| Example 16 | 57 | ○ | ○ | ○ | 1.66 |
| Example 17 | 58 | ○ | ○ | ○ | 1.64 |
| Example 18 | 57 | ○ | ○ | ○ | 1.60 |
| Example 19 | 56 | Δ | ○ | Δ | 1.51 |
| Comparative Example 6 | 58 | X | ○ | ○ | 1.65 |
| Comparative Example 7 | 57 | X | ○ | Δ | 1.44 |
| Comparative Example 8 | 56 | X | ○ | Δ | 1.61 |

TABLE 3

| | Gloss side | | | The opposite side | |
|---|---|---|---|---|---|
| No. | Glossiness | Scratch | Ink absorbability | Ink absorbability | Color formability |
| Example 20 | 58 | ◎ | ○ | ○ | 1.65 |
| Example 21 | 57 | ○ | ○ | ○ | 1.66 |
| Example 22 | 58 | ○ | ○ | ○ | 1.65 |
| Example 23 | 59 | ○ | ○ | ○ | 1.63 |
| Example 24 | 57 | ○ | ○ | ○ | 1.59 |
| Example 25 | 56 | Δ | ○ | Δ | 1.52 |
| Example 26 | 52 | ◎ | ○ | ○ | 1.66 |
| Example 27 | 46 | ◎ | Δ | ○ | 1.65 |
| Example 28 | 53 | ◎ | ○ | ○ | 1.67 |
| Example 29 | 62 | ◎ | ○ | ○ | 1.66 |
| Example 30 | 51 | ◎ | ○ | ○ | 1.82 |
| Comparative Example 9 | 58 | X | ○ | ○ | 1.65 |
| Comparative Example 10 | 56 | X | ○ | Δ | 1.41 |
| Comparative Example 11 | 57 | X | ○ | Δ | 1.58 |
| Comparative Example 12 | 53 | X | ○ | ○ | 1.67 |
| Comparative Example 13 | 61 | X | ○ | ○ | 1.65 |
| Comparative Example 14 | 50 | X | ○ | ○ | 1.83 |

In Examples 1–30, the sheets were inhibited from occurrence of scratches on the gloss side and had excellent ink absorbability and color formability. Particularly, in Examples 2–11 and 13, the considerably good gloss feeling and the inhibition of occurrence of scratches on the gloss side were both satisfied.

In Comparative Examples 1, 2, 6, 9, 12 and 13, serious scratches occurred on the gloss side. In Comparative Examples 3, 7 and 10, occurrence of scratches on the gloss side was somewhat inhibited, but the inhibition was insufficient. In addition, color formability was considerably inferior. In Comparative Examples 4, 8 and 11, scratches occurred to the same extent as in Comparative Example 1. In Comparative Examples 5 and 14, scratches occurred on both sides of the sheets.

INDUSTRIAL APPLICABILITY

According to the present invention, there are obtained double-side ink jet recording sheets having gloss on at least one side in which scratches caused by rubbing of sheets hardly occur on the gloss side.

The invention claimed is:

1. A double-side ink jet recording sheet comprising a paper support having at least one ink-receiving layer provided on each of both sides, wherein the ink-receiving layer on at least one side has gloss surface having a 75 ° specular glossiness of not less than 40% measured in accordance with JIS Z8741 and the outermost layer of the ink-receiving layer on the side of the paper support opposite to the side having gloss surface contains organic particles having an average particle diameter of 2–20 μm and the content of the organic particles in the outermost layer of the ink-receiving layer on the side of the paper support opposite to the side having gloss surface is 1–50% by weight and wherein the paper support is a member selected from the group consisting of a base paper, an art paper, a pigment-coated paper and a cast-coated paper.

2. A double-side ink jet recording sheet according to claim 1, wherein the outermost layer of the side having the gloss surface is subjected to pressure-contact specular finishing by cast-coating method.

3. A double-side ink jet recording sheet according to claim 2, wherein the gloss surface has a 75° specular glossiness of not less than 70% measured in accordance with JIS Z8741.

4. A double-side ink jet recording sheet according to claim 1, wherein the organic particles comprise a polyolefin resin.

5. A double-side ink jet recording sheet according to claim 1, wherein the outermost layer on the gloss surface side is subjected to a smoothing treatment by super calender.

6. A double-side ink jet recording sheet according to claim 1, wherein the organic particles comprise a polyolefin resin.

7. A double-side ink jet recording sheet according to claim 1, wherein the ink-receiving on layer the gloss surface side has a construction comprising at least an ink-absorbing layer comprising a pigment and a binder and a gloss developing layer comprising inorganic ultrafine particles having an average particle diameter of less than 1 μm and provided on the ink-absorbing layer as an outermost layer, and said pigment contained in the ink-absorbing layer is a salt of an alkaline earth metal.

8. A double-side ink jet recording sheet according to claim 7, wherein the gloss developing layer is provided by coating a coating solution on the ink-absorbing layer, and the coating solution for the gloss developing layer has a pH of not higher than 5.0.

9. A double-side ink jet recording sheet according to claim 7, wherein the salt of an alkaline earth metal is calcium carbonate.

10. A double-side ink jet recording sheet according to claim 7, wherein the inorganic ultrafine particles having an average particle diameter of less than 1 μm contained in the gloss developing layer is an amorphous synthetic silica prepared by a gas phase method or an alumina compound.

11. A double-side ink jet recording sheet according to claim 7, wherein the organic particles comprise a polyolefin resin.

12. A double-side ink jet recording sheet according to claim 7, the inorganic pigment is contained in an amount of 10–98% by weight and the binder is contained in an amount of 2–70% by weight based on the whole ink-receiving layer.

* * * * *